US005109995A

United States Patent [19]

Lou

[11] Patent Number: 5,109,995

[45] Date of Patent: May 5, 1992

[54] BEVERAGE DRINKING SET WITH STRAW HOLDER

[76] Inventor: Kwong L. Lou, 6402 N. San Gabriel Blvd., San Gabriel, Calif. 91775

[21] Appl. No.: 601,119

[22] Filed: Oct. 18, 1990

[51] Int. Cl.[5] ..... A47G 19/22; A47G 21/18

[52] U.S. Cl. ..... 215/1 A; 220/707; 220/709; 229/103.1; 215/229

[58] Field of Search ..... 215/1 A, 229, 101; 229/103.1, 906.1; 220/90.2, 90.4, 90.6, 105, 707-710; 239/19, 33

[56] References Cited

U.S. PATENT DOCUMENTS

| | | | |
|---|---|---|---|
| Re. 25,448 | 9/1963 | Cohen et al. | 229/103.1 |
| 2,800,265 | 7/1957 | Pugh, Sr. | 229/103.1 |
| 2,957,614 | 10/1960 | Krascouic | 229/103.1 |
| 3,173,566 | 3/1965 | Talbert | 215/229 |
| 3,178,081 | 4/1965 | Adams | 215/1 A |
| 3,240,415 | 3/1966 | Pugh, Sr. | 229/103.1 |
| 4,043,478 | 8/1977 | Duncan | 215/1 A X |
| 4,291,814 | 9/1981 | Conn | 215/229 X |
| 4,485,963 | 12/1984 | Panicci | 215/229 X |
| 4,714,173 | 12/1987 | Ruiz | 229/103.1 X |
| 4,830,204 | 5/1989 | Lin | 220/90.6 X |

FOREIGN PATENT DOCUMENTS

| | | | |
|---|---|---|---|
| 1246318 | 10/1960 | France | 215/229 |
| 2485360 | 12/1981 | France | 215/229 |
| 454732 | 6/1968 | Switzerland | 215/1 A |

*Primary Examiner*—Sue A. Weaver
*Attorney, Agent, or Firm*—Wen Liu

[57] ABSTRACT

A beverage serving set comprising a drinking straw and beverage container combination wherein the drinking straw is L-shaped having long and short parts, and the container has a guiding structure for maintaining the long part vertical in the container and the short part parallel to the lid of the container. The long part is slidable and rotatable in the guiding structure which may be an adapter depending from the lid or a guiding tube attached to the container wall. A clip is provided on the lid to securely hold the short part of the straw for storage, and in addition a cap may be provided at the clip for capping the end of the short part of the straw.

21 Claims, 3 Drawing Sheets

BEVERAGE DRINKING SET WITH STRAW HOLDER

BACKGROUND OF THE INVENTION

1. Field of the Invention

The subject invention generally relates to beverage serving apparatus, more particularly to the combination of drinking straw and beverage container.

2. Description of Related Art

The current procedure carried out in serving beverages at beverage stands include picking up a cup, filling it up with beverage, capping the cup with a matching lid, and inserting a straw into the cup through the lid. The long and movable straw used for drinking can be inconvenient, especially for large (i.e. tall) containers which need a considerably long straw.

U.S. Pat. No. 3,684,123 provides a slot-shaped opening at the lid edge to allow a person to drink from the opening by inclining the cup or mug, like drinking from a canned beer or soda. The beverage consumed is taken first from the top level and then at levels progressively downwards in the container. There is no way to randomly choose different beverages from the different levels in the cup or mug. A large cup of beverage usually contains more than one kind of beverage, such as beverage diluted by ice on top. It is desirable to allow a person to suck different beverages from different depths alternately.

SUMMARY OF THE INVENTION

It is therefore the object of the present invention to provide a drinking straw in a shorter version, steadily held by the container in the drinking position, and safely held by the container when carrying or storing.

The object is accomplished by using a L-line beverage straw with the long leg inserted into the cup or mug through the lid, and the short leg maintained parallel to the lid.

Further, means is provided to hold the short leg on the lid for carrying, or for serving, or for both, and to cap the short leg end when needed.

Furthermore, means is provided to maintain the long leg perpendicular to the cup bottom and allow the long leg to be freely swivelable and slidable to the desirable serving positions, and to the carrying position.

DETAIL DESCRIPTION OF PREFERRED EMBODIMENT

Figure 1:
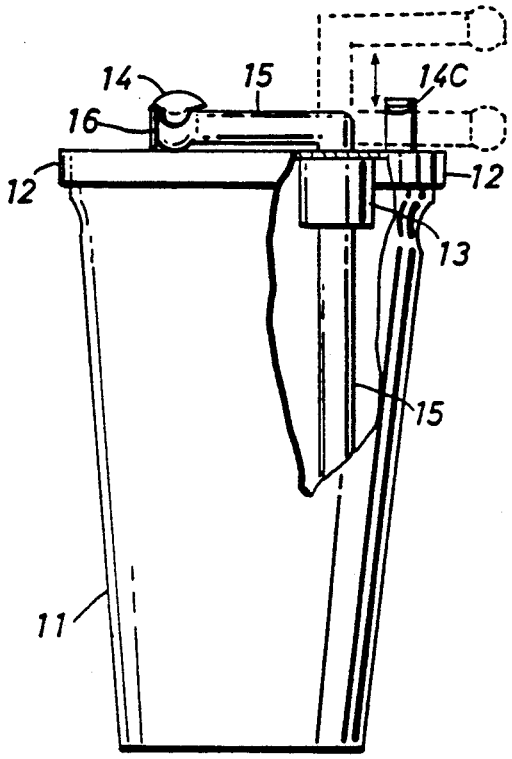
FIG. 1 is a side elevation view of one embodiment of the present invention with a portion of a cup removed for showing the inverted L-line straw passing through the adapter; dotted lines showing the range of positions of the short part of the L-line straw.
Figure 2:
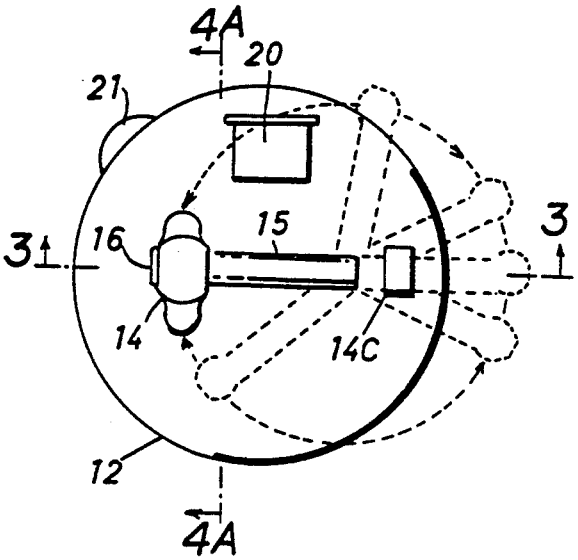
FIG. 2 is a top elevation view of FIG. 1 showing the short part of the L-line straw at various positions on the lid, as indicated by dotted lines and arrows.
Figure 3:
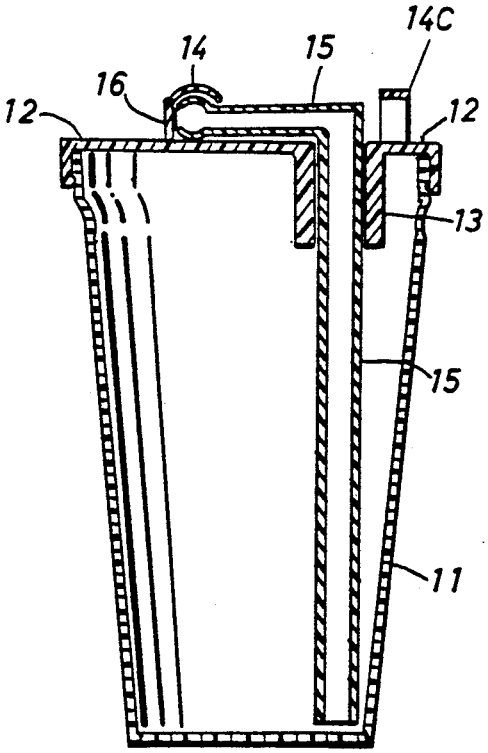
FIG. 3 is a sectional view taken in the plane indicated by line 3—3 of FIG. 2.

Referring to FIGS. 1 through 3, a beverage container such as a cup or mug 11 is capped by a matching lid 12. An adapter 13 integral to the lid 12 depends downwardly. An elastic clip unit 14 is located on the lid diametrally across from the adapter 13. The adapter 13 slidably supports a L-line straw 15 which has a short and a long part. As seen in FIG. 1, the straw is designed to be permanently in the L-shape at nominal conditions, i.e. not designed to be adjusted for other shapes under normal use conditions. The long part is inserted through the adapter 13 into the cup or mug 11. The long part is equal to the depth of the cup or mug 11. The long part can be freely swiveled and slidable up-and down vertically with respect to the adapter 13, as shown by arrows and dotted lines in FIGS. 1 and 2.

The short part of the L-line straw is maintained parallel to the lid 12 by the adapter 13. The short part has a length equal to the distance between the adapter 13 and the elastic clip unit 14, as shown in FIGS. 1, 2 and 3, so that its end can be held by the elastic clip unit 14 securely on the lid 12 when it is not in use. The short part can be swiveled to point its end away from the lid 12 for drinking, and lifted to various vertical positions to allow one to choose the different beverages from different levels in the cup or mug 11.

The elastic clip unit 14 and the adapter 13 are preferably aligned along a diameter of the lid 12, to get the maximum distance between the elastic clip unit 14 and the adapter 13, and in turn to accommodate sufficient length of the short part of said L-line straw so that when its end is swiveled away from the lid it can cover a wider range of positions during serving. The short part can be swiveled back to be held by the elastic clip unit 14 parallel to the lid in a storing position.

Figure 4A:
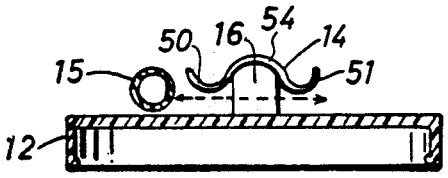
FIG. 4A is a sectional view taken in the plane indicated by line 4A—4A of FIG. 2, showing one embodiment of an elastic clip-and-cap unit which opens laterally for the straw.

The elastic clip unit 14 can be in various configurations. For example, FIG. 4A shows a clip configuration which opens laterally. The portions 50 and 51 at both ends are bendable upward. The mid portion 54 is sized to receive the short part end of the L-line straw 15 in a securely held position. The straw's short part end can be moved by the user to force the portions 50 and 51 of the clip to bend to allow the short part to move in or out of the securely held position. In the securely held position, a small vertical wall 16 of the clip unit 14 functions to cap the short part end.

Figure 4B:
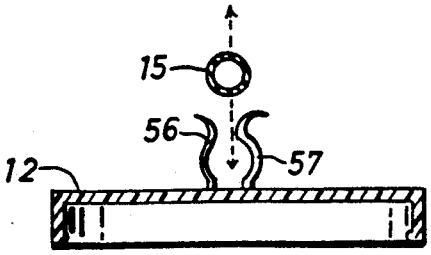
FIG. 4B shows a modified clip unit which opens upwardly.

FIG. 4B shows an alternate clip configuration which opens upwardly. Two S-shaped elastic pieces 56 and 57 define a position for securing the short part end of the L-line straw 15. The upper ends of the elastic pieces restrict the short part end from moving in-and-out unless sufficient force is imparted to bend the pieces 56 and 57. In FIG. 4A the short part end is swiveled laterally in and out of the clip as shown by the horizontal dotted line and arrows; and in FIG. 4B the short part end is movable vertically in and out of the clip as shown by the vertical dotted line and arrows.

Furthermore, an additional clip unit 14C can be set at nearby the adapter 13, preferably to the right of the adapter 13, as shown in FIGS. 1 through 3. It is to hold the short part of the L-line straw 15, but not to hold its end, at a preset drinking position with the long part of the straw fully extended into the cup or mug 11 which will allow one to suck the beverage from the bottom of the cup or mug 11. This clip unit 14C without cap portion may have elastic portions like the clip units described with respect to FIGS. 4A and B.

The adapter 13 is either molded integral with or detachable from the lid 12, its length is generally proportional to the depth of the cup or mug 11, relative to the length of the long part of the L-line straw 15. It is easily modified to other configurations. FIGS. 1, 3, 5 and 6 illustrates two examples of the adapter 13.

Figure 5:
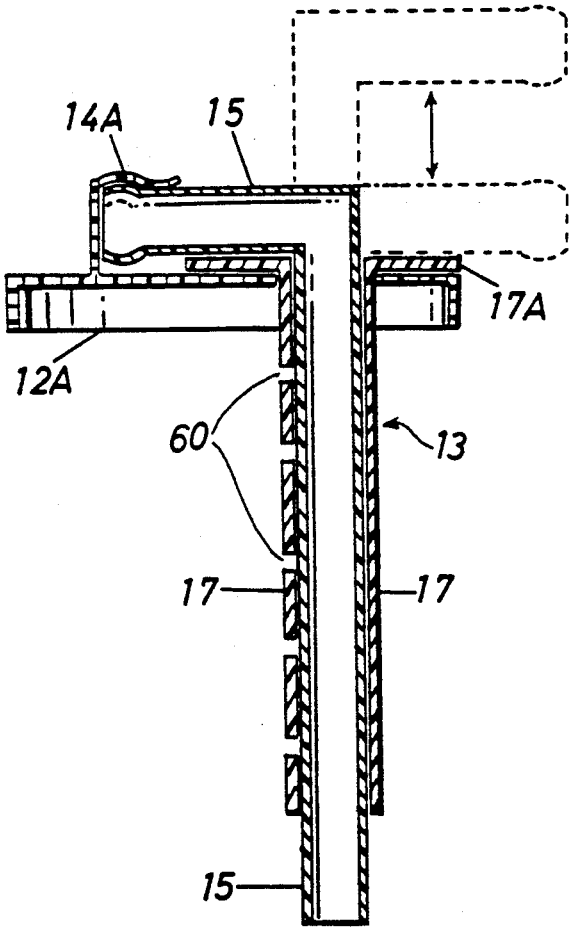
FIG. 5 is a sectional view showing a modified straw adapter different from that shown in FIG. 3.
Figure 6:
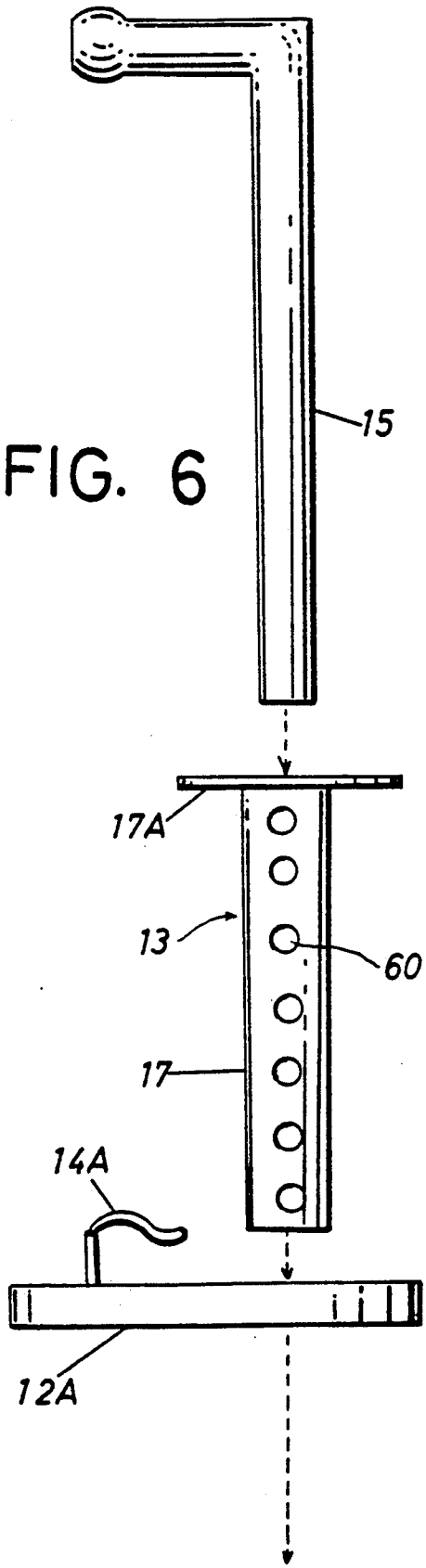
FIG. 6 is an exploded view of FIG. 5 showing the assembly of the components.

FIGS. 5 and 6 show an adapter 13 having a long guiding tube 17 for large size cups or mugs which need a long L-line straw. It is configured like a bushing with a big flat flange 17A at top end. The tube 17 is inserted through the opening in the lid and depends downwardly with the flat flange 17A resting on the lid 12A. The long part of the L-line straw 15 freely slides in the bushing-type guiding tube 17, same as the adapter 13 described above with reference to FIGS. 1 to 3. The assembly of the adapter, straw and the lid are shown in FIG. 6.

Figure 7:
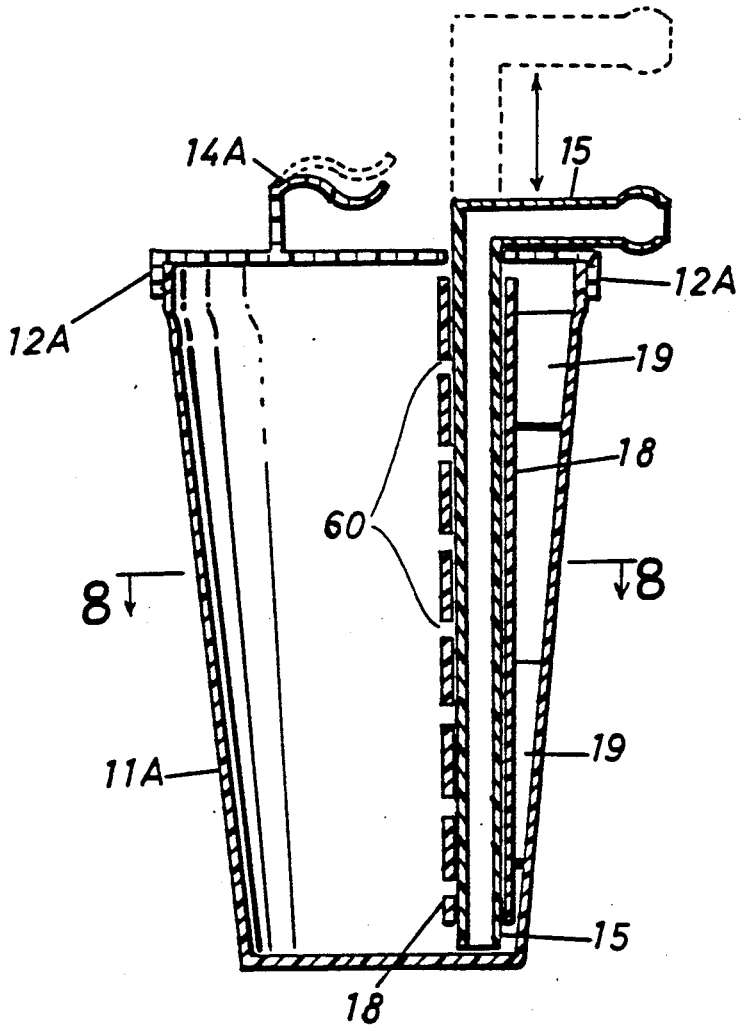
FIG. 7 is a sectional view showing a built-in straw guiding tube instead of the adapter under the lid.
Figure 8:
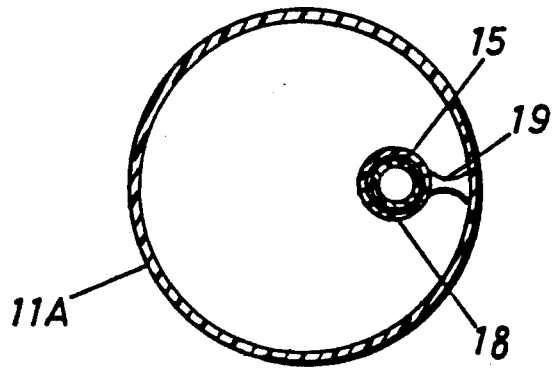
FIG. 8 is a sectional view taken in the plane indicated by line 8—8 of FIG. 7, showing the cup and the built-in guiding tube linked by ribs.

Alternative to using adapters, FIGS. 7 and 8 show the to the cup bottom, but not touching the bottom. In the taper shaped cup 11A, the gap between the guiding tube 18 and the cup 11A is linked by rib or ribs 19. The opening in the lid 12A is aligned with the built-in guiding tube 18 when capped; and the long part of the L-line straw 15 freely slides into the guiding tube, same as the adapters 13 described above.

Circular openings 60 are provided along the long adapter such as bushing-type guiding tube 17 and built-in guiding tube 18 for letting beverages at different levels to flow into the guiding tube. The openings may be in slots or any other shapes.

Referring back to FIG. 2, on the lid an inlet 20 with cap is provided for refilling beverage into the cup or mug without having to open the bigger lid 12. Also a lip 21 is set at the lid edge for lifting the bigger lid. Similar features may be provided in the other embodiments.

The short part of the L-line straw 15 has a slightly enlarged rounded nipple end for sucking beverage as shown in the drawings.

Parts made of plastic or resin materials are usually elastic and are widely used for capping and holding purposes. Detail description of the capping and connecting in the embodiments are omitted.

In the current market, cups and lids are classified in small, medium and large sizes, and in addition, special size for ones that are reusable. Within a size, the lids and cups are usually matched. The straws are usually oversized. The cup is applicable to some of the preferred embodiments without any modification.

What is claimed is:

1. A beverage serving set comprising:

a beverage container for holding beverages to be consumed;

a lid covering the container;

a drinking straw permanently in L-shape having a short part and a long part, the long part being of a length to be extended into the container through the lid and adjacent the container bottom; and sleeve means for freely slidably and rotatably supporting the long part of the straw through the lid, and maintaining the long part perpendicular to the lid and the short part parallel to the lid during consumption of the beverage, whereby the short part of the straw can be positioned at various heights above the lid for a desired drinking position.

2. The invention of claim 1 further comprising securing means defined on the lid for securely holding the short part close to the lid in a storing position.

3. The invention of claim 2 wherein the securing means is an elastic clip attached on the lid.

4. The invention of claim 3 wherein the end of the straw is slightly enlarged to facilitate holding by the clip.

5. The invention of claim 4 wherein the lid is circular with a center and the sleeve means and the clip are positioned diametrally across with respect to the center of the lid.

6. The invention of claim 3 wherein the short part of the straw has an opening through which the beverage is consumed and the clip comprises a capping member for capping the end of the short part.

7. The invention of claim 6 wherein the clip is configured and operable to release and receive the short end laterally.

8. The invention of claim 3 wherein the clip is configured and operable to release and receive the short end laterally.

9. The invention of claim 8 wherein the clip comprises a flexible portion supported on the lid and spaced apart from the lid such that the short part of the straw can be received in the between said portion and the lid by inserting the short part laterally between said portion and the lid.

10. The invention of claim 3 wherein the clip is configured and operable to release and receive the short end vertically.

11. The invention of claim 10 wherein the clip comprises two flexible portions extending away from the lid, the portions being spaced apart at a distance such that the short part of the straw can be securely held by inserting the short part between the two portions.

12. The invention of claim 1 wherein the sleeve means comprises an adapter having a flange and a guiding tube, the guiding tube being inserted through an opening in the lid with the flange resting on the lid and the guiding tube depending from the lid, the guiding tube having an axial hole through which the long part of the straw is freely slidably and rotatably supported.

13. The invention of claim 12 wherein holes are provided along the depending guiding tube whereby beverage at different levels in the container can flow into the guiding tube.

14. The invention of claim 1 wherein the sleeve means comprises an adapter integral to the lid and depending downward from the lid, the adapter having a guiding tube which has an axial hole through which the long part of the straw is freely slidably and rotatably supported.

15. The invention of claim 14 further comprising securing means defined on the lid for securely holding the short part close to the lid in a storing position.

16. The invention of claim 15 further comprising a clip-unit that is positioned on the lid along the line of the securing means and the sleeve means with the sleeve means between the securing means and the clip-unit, whereby the short part of the straw is rotatable from the storing position where the short part is held by the securing means to a preset drinking position where the short part is held by the clip-unit in a position with the end of the short part extending parallel but pointing away from the lid.

17. The invention of claim 1 wherein the sleeve means comprises a guiding tube attached to the container, the guiding tube being perpendicular to the lid, the guiding tube having an axial hole for freely slidably and rotatably supporting the long part of the straw.

18. The invention of claim 17 wherein holes are provided along the guiding tube whereby beverage at different levels in the container can flow into the guiding tube.

19. The invention of claim 3 wherein the lid is circular with a center and the sleeve means and the clip are positioned diametrally across with respect to the center of the lid.

20. The invention of claim 19 further comprising a clip-unit that is positioned on the lid along the line of the clip and the sleeve means with the sleeve means between the clip and the clip-unit, whereby the short part of the straw is rotatable from the storing position where the short part is held by the clip to a preset drinking position where the short part is held by the clip-unit in a position with the end of the short part extending parallel but pointing away from the lid.

21. The invention of claim 1 wherein the lid further comprises a filler inlet and cap to facilitate refilling the container with beverage.

* * * * *